US007191686B1

(12) United States Patent
Angelle et al.

(10) Patent No.: US 7,191,686 B1
(45) Date of Patent: Mar. 20, 2007

(54) METHOD AND APPARATUS FOR CONNECTING AND DISCONNECTING THREADED TUBULARS

(75) Inventors: Jeremy R. Angelle, Lafayette, LA (US); Donald E. Mosing, Lafayette, LA (US); Robert L. Thibodeaux, Jr., Lafayette, LA (US); Christopher B. Pechon, Lafayette, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 0 days.

(21) Appl. No.: 11/344,625

(22) Filed: Feb. 1, 2006

(51) Int. Cl.
*B25B 13/50* (2006.01)

(52) U.S. Cl. ..... 81/57.34; 81/57.16

(58) Field of Classification Search ..... 81/57.34, 81/57.36, 57.39, 57.16
See application file for complete search history.

(56) References Cited

U.S. PATENT DOCUMENTS

| | | | | |
|---|---|---|---|---|
| 4,200,010 | A * | 4/1980 | Hewitt | 81/57.16 |
| 4,346,631 | A * | 8/1982 | Boyadjieff | 81/57.34 |
| 4,497,224 | A * | 2/1985 | Jurgens | 81/57.34 |
| 4,512,216 | A | 4/1985 | Callegari, Sr. | |
| 4,603,464 | A | 8/1986 | Smith, Jr. et al. | |
| 4,694,712 | A | 9/1987 | Doss | |
| 4,696,206 | A * | 9/1987 | Renfro | 81/57.34 |
| 4,732,061 | A * | 3/1988 | Dinsdale | 81/57.34 |
| 4,739,681 | A * | 4/1988 | Pietras | 81/57.16 |
| 4,765,401 | A * | 8/1988 | Boyadjieff | 166/77.53 |
| 4,895,056 | A | 1/1990 | Schulze-Beckinghausen | |
| 5,386,746 | A | 2/1995 | Hauko | |
| 6,213,216 | B1 | 4/2001 | Rogers | |
| 6,341,665 | B1 | 1/2002 | Zhou et al. | |
| 6,634,259 | B2 | 10/2003 | Castille | |
| 6,715,569 | B1 | 4/2004 | Rogers | |
| 6,851,335 | B2 * | 2/2005 | Johnson | 81/64 |
| 7,076,852 | B2 * | 7/2006 | Penman et al. | 29/426.5 |
| 2002/0157823 | A1 * | 10/2002 | Pietras et al. | 166/78.1 |
| 2004/0103515 | A1 | 6/2004 | Penman et al. | |

FOREIGN PATENT DOCUMENTS

| | | |
|---|---|---|
| GB | 2 160 807 A | 1/1986 |
| GB | 2 344 781 A | 6/2000 |
| GB | 2 387 186 A | 10/2003 |
| WO | WO 01/81047 A1 | 11/2001 |

* cited by examiner

*Primary Examiner*—David B. Thomas
(74) *Attorney, Agent, or Firm*—Streets & Steele; Patrick K. Steele

(57) ABSTRACT

A system for screwing together threaded connections includes a pair of moveable arms which first grip the tubular to provide a contact force against three hydraulically powered drive rollers, that are contained within the arms. The three drive rollers will screw or "spin" the connection to an initial torque value. The moveable arms also contain a set of jaws (three) which extend radially inwardly to grip the tubular, so the connection can be made up to final torque by contracting a hydraulic cylinder. The hydraulic cylinder that is used to apply the final torque value is attached on one end, where the moveable arms are pinned together, and on the other end to something fixed, such a snub post or derrick leg. Rotation of the opposing connection is prevented by the use of standard equipment such as a manual chain tong.

23 Claims, 4 Drawing Sheets

METHOD AND APPARATUS FOR CONNECTING AND DISCONNECTING THREADED TUBULARS

BACKGROUND OF THE INVENTION

1. Field of the Invention

The present invention relates to a method and apparatus for connecting and disconnecting threaded tubulars to or from a tubular string in a wellbore.

2. Background of the Related Art

The process of drilling and installing casing in a wellbore requires the connection or makeup of many sections of tubulars, such as drill pipe or casing. These sections of tubulars may be individual joints or stands of multiple joints. As a wellbore deepens, more tubulars must be threadably connected onto the string. Consequently, the process of threadably connecting tubulars is an important part of wellbore operations and utilizes a significant amount of time and equipment. Furthermore, a tubular string may need to be removed from the wellbore for a variety of reasons, such as replacing a drill bit or due to cross-threading of casing. Accordingly, disconnection or break out of many tubular sections is also an important part of wellbore operations.

In order to improve the quality of threaded connections and make efficient use of expensive rig equipment, many different power tongs have been developed. For example, U.S. Pat. No. 5,386,746 discloses an apparatus for making and breaking wellbore tubulars that includes a frame supporting up to three power jaws aligned vertically with respect to each other. The middle set of power jaws is reverse oriented to the upper and lower sets of power jaws and cooperates with either the upper set or the lower set to effect torquing.

U.S. Pat. No. 6,634,259 discloses a power tong having a plurality of power jaws and a power spinner for spinning wellbore tubulars. The power spinner spins a tubular at a relatively high speed but at a relatively low torque while holding another tubular fixed with one of the power jaws. The spin process continues until the two threaded tubulars shoulder up, e.g. until a pin shoulder engages the box shoulder. After shouldering up, the power spinner is stopped and two of the power jaws are used to apply high torque to the connection or joint in a well known manner so that the joint is securely fastened and sealed. The application of high torque continues to rotate the tubulars with respect to each other but at a very low speed or rotation. However, once the tubulars are shouldered, only a small amount of further rotation is necessary to complete the connection. Likewise, when breaking out joints, two power jaws apply a high torque to initially break the connection. Then the power spinner spins one tubular with respect to another tubular held by a power jaw until the threaded connection is completely disconnected. In this manner, the connection can be quickly made or broken to save considerable time and money while drilling a well.

What is needed is an apparatus that can both spin a tubular to establish a threaded connection and apply a final torque value to the threaded connection. It would be desirable to have such an apparatus that was simpler and took less space.

SUMMARY OF THE PRESENT INVENTION

The present invention includes an apparatus or spinner-wrench for connecting threaded tubulars. The apparatus comprises a pair of arms pivotably coupled at a distal end; a first displacer secured to the pair of arms for selectively moving a proximal region of the pair of arms into an open position for receiving or withdrawing a tubular and into a closed position for engaging and rotating a tubular; three or more rollers rotationally secured to the proximal region of the pair of arms with at least one roller secured to each arm, the rollers collectively adapted for spanning at least 180 degrees of the circumference of a tubular received and engaged between the arms in the closed position, wherein at least one of the rollers is a drive roller for spinning a tubular; two or more jaws secured to the proximal region of the pair of arms with at least one jaw secured to each arm, the jaws collectively spanning at least 180 degrees of the tubular circumference for selectively gripping a tubular with the arms in the closed position; and a second displacer secured between the distal end of the pair of arms and a fixed structure, wherein the fixed structure is positioned so that actuating the second displacer applies a generally tangential force for applying a final torque value to a tubular gripped by the jaws. The first and second displacers may be independently selected from a hydraulic cylinder, a pneumatic cylinder, a jack, and a winch.

A backup tong prevents the stump, or proximal end of the tubular string, from rotating during the application of torque by the spinner-wrench to the tubular segment being added to the tubular string. Optionally, the backup tong may be operated manually, pneumatically or hydraulically. The backup tong may be secured using a backup snubline to a fixed structure to oppose the torque of the spinner-wrench, or it may be rotatably coupled to the spinner-wrench to form an integral structure. In the latter configuration, the spinner-wrench grips and rotates the tubular segment being added to the tubular string at a location just above the threaded portion, while the backup tong holds the tubular string at a location just below the threaded portion. The backup tong holds the tubular string stationary against the torque applied to the tubular segment and also secures the arms of the spinner-wrench for application of torque to the tubular segment. Where a fixed structure is used to secure the backup tong, the backup snubline and the second displacer may have one end secured to the same fixed structure, such as a snub post. The spinner-wrench apparatus, with or without an integral backup tong, may be configured so that the torque applied by the second displacer is rotationally directed to makeup the tubular or rotationally directed to break out the tubular.

In a preferred embodiment, the three or more rollers extend a fixed distance radially inward from the arms for engaging the tubular. It is also preferred that the two or more jaws are each secured to the pair of arms by separate displacers for selectively moving the two or more jaws between a disengaged position radially outward of the three or more rollers and an engaged position radially inward of the three or more rollers.

The apparatus preferably includes a load cell disposed to measure the force applied to the tubular. The load cell may be used to measure torque while spinning the tubular and while applying a generally tangential force to achieve a final torque value.

Another embodiment of the invention provides a method of making a threaded connection between tubulars. The method includes axially aligning a tubular for threadably connecting with a tubular string; positioning a proximal region of a pair of moveable arms around the tubular; closing the pair of moveable arms around the tubular to create a contact force between three or more rollers, including at least one drive roller, and the tubular, wherein the three or more rollers are collectively adapted for maintaining axial alignment of the tubular; securing the tubular string to oppose rotation; spinning the tubular in a makeup direction to threadably connect the tubular; extending two or more jaws from the pair of moveable arms to a position radially inward of the rollers to securely grip the tubular; directing a generally tangential force against a distal end of the pair of moveable arms in the makeup direction to apply a final torque value to the threaded connection; and opening the pair of moveable arms to disengage the tubular.

In one embodiment, the step of directing a generally tangential force against a distal end of the pair of moveable arms includes actuating or retracting a displacer coupled between the distal end and a fixed structure. Preferably, the step of securing the tubular string to oppose rotation includes attaching a manual backup tong, such as wherein the displacer and the manual backup tong are secured to the same fixed structure.

Another embodiment includes spinning the tubular in the makeup direction until achieving a threaded connection that is less than one-quarter turn of the tubular from arriving at a target final torque value. Optionally, the spinning is controlled by a drive motor driving the at least one drive roller. The method may further include automatically stopping the drive motor and extending the jaws upon detecting a predetermined toque value that is less than the target final torque value.

The foregoing, as well as other, objects, features, and advantages of the present invention will be more fully appreciated and understood by reference to the following drawings, specification and claims.

DETAILED DESCRIPTION OF A PREFERRED EMBODIMENT

Figure 1:
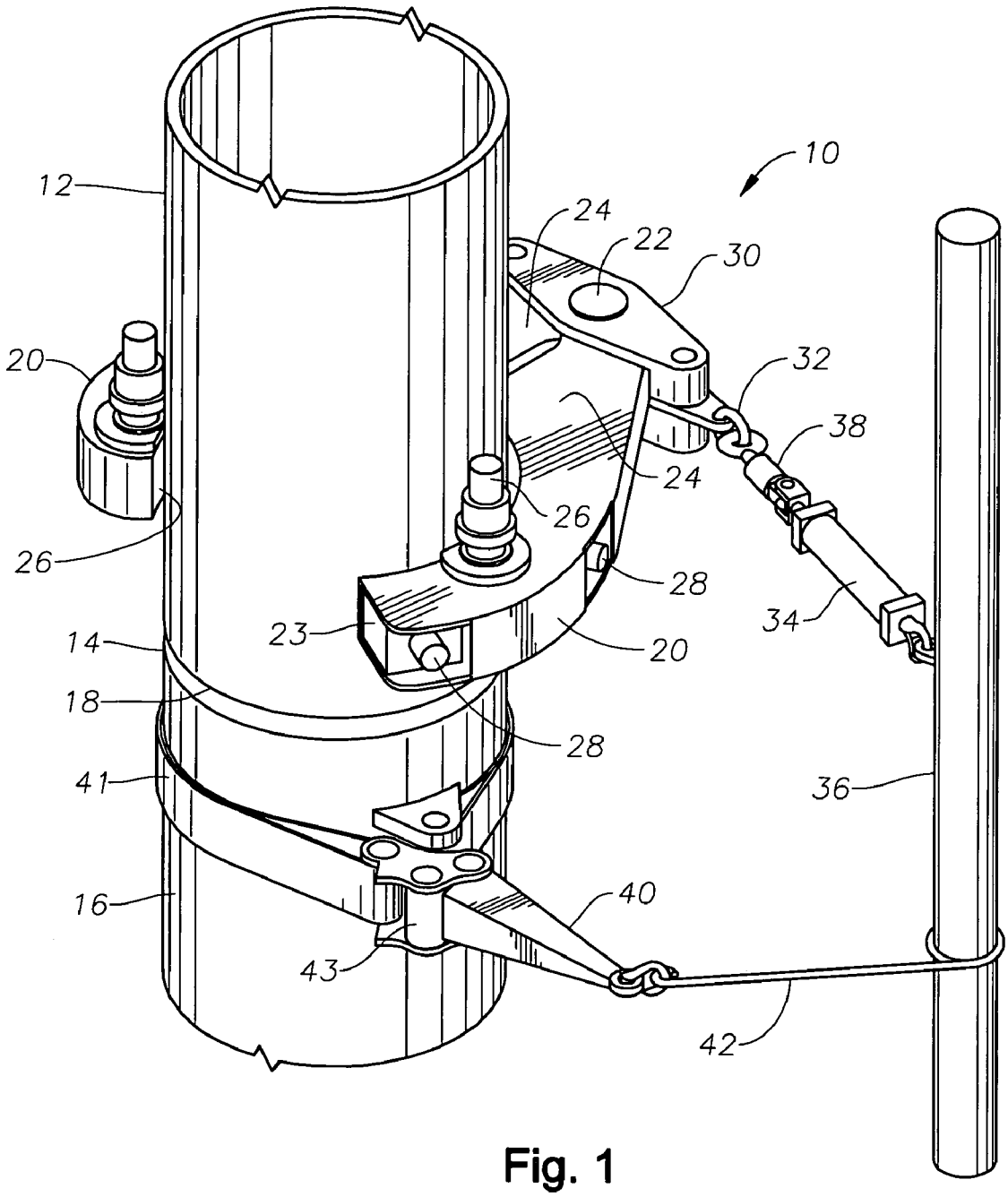
FIG. 1 is a perspective view of one embodiment of an apparatus for connecting threaded tubulars.

FIG. 1 is a perspective view of one embodiment of an apparatus for connecting threaded tubulars. The apparatus 10 is shown engaging a tubular 12 above a downwardly directed threaded pin 14 that is to be connected to a tubular string 16 having an upwardly directed threaded box 18. The tubular string 16 extends axially downward into the wellbore and the tubular 12 is suspended by a lift elevator (not shown) and positioned in axial alignment with the tubular string 16 to facilitate the connection. The apparatus 10 operates in a generally horizontal plane that is perpendicular to the axis of the tubular 12. The apparatus 10 includes a pair of arms 20 that are hingedly coupled by a hinge pin 22 at their distal ends 24. The pair of arms 20 forms an opening between the proximal ends 23 of the arms to receive the tubular 12. Collectively, the pair of arms 20 includes three or more rollers 26 and two or more jaws 28 (See also FIG. 2). Preferably, there are three or more rollers 26 spanning more than 180 degrees around the circumference of the tubular 12 and two or more jaws 28 spanning more than 180 degrees around the circumference of the tubular 12. Most preferably the rollers and jaws both span more than 200 degrees around the circumference of the tubular to more securely grip and hold the tubular in axial alignment. The apparatus 10 may be referred to as a "spinner-wrench" because it includes both rollers for spinning the tubular and jaws for serving as a wrench or power tong.

The apparatus 10 is also shown with a collar 30 pivotally secured to the hinge pin 22 and having opposing couplings 32. A displacer 34, such as a hydraulic cylinder, pneumatic cylinder or screw jack, has one end secured to a coupling 32 of the collar 30 and a second end secured to a fixed structure 36. The apparatus preferably also includes a load cell 38 for measuring forces. The load cell is most conveniently placed in series between the displacer 34 and the collar 30 in order to measure the forces being applied to the threaded connection. The displacer 34 serves to prevent counter-rotation of the apparatus 10 when spinning the tubular and serves to provide high torque rotation over a short distance when actuated. Accordingly, the load cell 38 can continuously measure a force that is representative of the torque being applied to the threaded connection. These force measurements are useful for controlling the spinner and torquing operations.

Preferably, the apparatus 10 is used in cooperation with another gripping apparatus, such as a power jaw, spider or a manual backup tong. Such a gripping apparatus, hereinafter referred to as the manual backup tong, is used to prevent rotation of the tubular string 16 while the threaded connection is being made up. The manual backup tong 40 is shown with a strap 41 extending around the tubular string 16 and a buckle 43 that is secured to the fixed structure 36 by a backup snubline 42. As shown in FIG. 1, the apparatus 10 is arranged to makeup the threaded connection by rotating the tubular 12 in a clockwise direction (as viewed from above) while the manual backup tong 40 is arranged to prevent clockwise rotation of the tubular string 16. It should be understood that a spider comprising a set of slips to engage and support the pipe string may provide the requisite gripping of the pipe string to prevent rotation during the application of torque by the apparatus 10 to make up the threaded connection. Generally, a spider, as that term is used above, includes any device for securing and supporting a pipe string at or near the rig floor using a generally circumferential arrangement of slips received within a tapered bowl and configured to restrict unwanted rotation of the pipe string.

Generally, the spinning with the rollers and the torquing with the jaws will be performed in the same direction, such as spinning and torquing in a clockwise direction for making up a threaded connection, and spinning and torquing in a counterclockwise direction for breaking out a threaded connection. It should also be recognized that the backup tong or spider should be set on or engaged at the tubular string 16 opposite the threaded connection and be set in a manner that will oppose the rotation being applied to the tubular 12.

Figure 2:
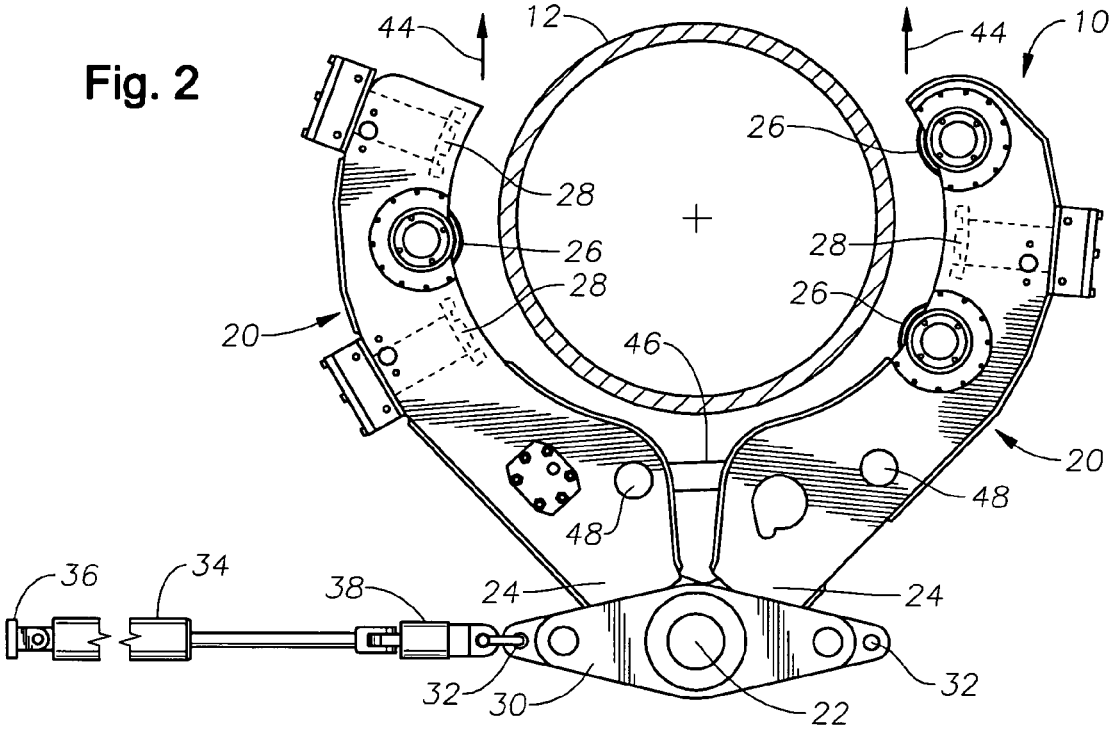
FIG. 2 is a top view of the spinner-wrench with arms in an open condition.

FIG. 2 is a top view of the spinner-wrench 10 with arms 20 in an open condition. In the embodiment shown in FIG. 2, the arms 20 of the spinner-wrench do not have to open a large distance in order to receive the tubular 12 there between. While the spinner-wrench 10 may be mounted or supported in many of the same ways as any power tong, such as being suspended on cables, the spinner-wrench 10 is positioned around the tubular 12 from one side of the tubular with movement as shown by directional arrows 44. The preferred movement is a generally within the horizontal plane in which the spinner-wrench 10 will be used. The arms 20 preferably do not surround the entire tubular 12, but must span around more than 180 degrees of the tubular. The arms carry a set of rollers 26 for engaging and spinning the tubular 12 and a set of jaws 28 for torquing the tubular 12. It is preferred that the set of rollers 26 engage to span at least about 180 degrees of the tubular 12. It is important that the set of jaws 28 engage to span at least about 180 degrees of the tubular 12. The span established by the rollers is preferably offset from the span established by the jaws in order to facilitate a generally horizontal arrangement of rollers and jaws in the same pair of generally opposed arms.

In determining how far the rollers or jaws span around a tubular, it should be recognized that the spinner-wrench 10 may be self-adjustable to various diameters of tubulars. For example, the rollers may be spring-loaded or displaceable toward or away from the tubular in order for the rollers to engage tubulars of varying diameters. Such a displacement could be accomplished in much the same manner as the displaceable jaws disclosed herein. However, it is preferred that the rollers be fixed to the arms with a vertical axis, in which case all of the rollers may be positioned by the arms to contact tubulars having a range of diameters if the spinner-wrench has exactly three rollers. While there is no great disadvantage in having additional rollers that do not engage a tubular, it is important that the rollers that engage a tubular span at least about 180 degrees of the tubular, i.e., the contact points of each roller that lie in a given generally horizontal plane define an arc that is more than 180 degrees. Accordingly, the preferred arrangement of rollers is a set of exactly three rollers having an axis of rotation that is generally fixed on the arms. Still, a small degree of flexing or biasing is permitted. A particular spinner-wrench may be designed so that a set of three rollers will engage tubulars over a given range of tubular diameters. Furthermore, the fixed rollers may be repositionable into other fixed locations on the arms in order to better accommodate different tubular diameters.

The jaws must also span around more than 180 degrees of the tubular diameter in order to achieve and maintain a positive grip on the pipe. Furthermore, it is generally preferred that the jaws have sufficient contact surface area and texture, as will be known in the art, in order to grip the pipe and transfer the desired amount of torque. However, since each individual jaw may extend more or less than the other jaws, the jaws may also be considered to be self-adjustable over a range of tubular diameters. This also means that the jaws generally remain self-adjustable independent of the number of jaws. Therefore, the number of jaws may be two, three, four or more jaws, so long as the set of jaws engage or contact the tubular over a span that is at least about 180 degrees around the tubular. Furthermore, it should be recognized that each jaw will have a contact surface area that itself may span several degrees around the tubular. For example, two jaws set exactly 180 degrees apart on opposing sides of a tubular may nonetheless span 200 degrees around the tubular if each jaw has a generally concave contact surface that spans 20 degrees of the tubular. Optionally, one or more jaws may be fitted with pivotable engaging surfaces for maximizing contact area for gripping a range of tubular diameters.

While a span of greater than 180 degrees is essential, both the set of rollers and the set of jaws preferably span more than 190 degrees, and most preferably span more than 200 degrees. Furthermore, a span greater than 225 degrees is generally unnecessary and begins to make the spinner-wrench more difficult to use.

The arms 20 are held in the open condition by extending the displacer 46 that is operably coupled to each of the two arms 20 at a position between the distal ends 24 of the arms and the proximal ends 23 of the arms that secures the rollers and jaws and receives the tubular 12. The displacer 46 achieves greater leverage as it is positioned a greater distance from the hinge pin 22, but the displacer must also avoid obstructing the arms from receiving the tubular. The displacer 46 is preferably pivotally coupled to each arm 20 with a pivot pin 48, since the angle between the displacer and each of the arms will change slightly as the arms are actuated opened and closed.

Figure 3:
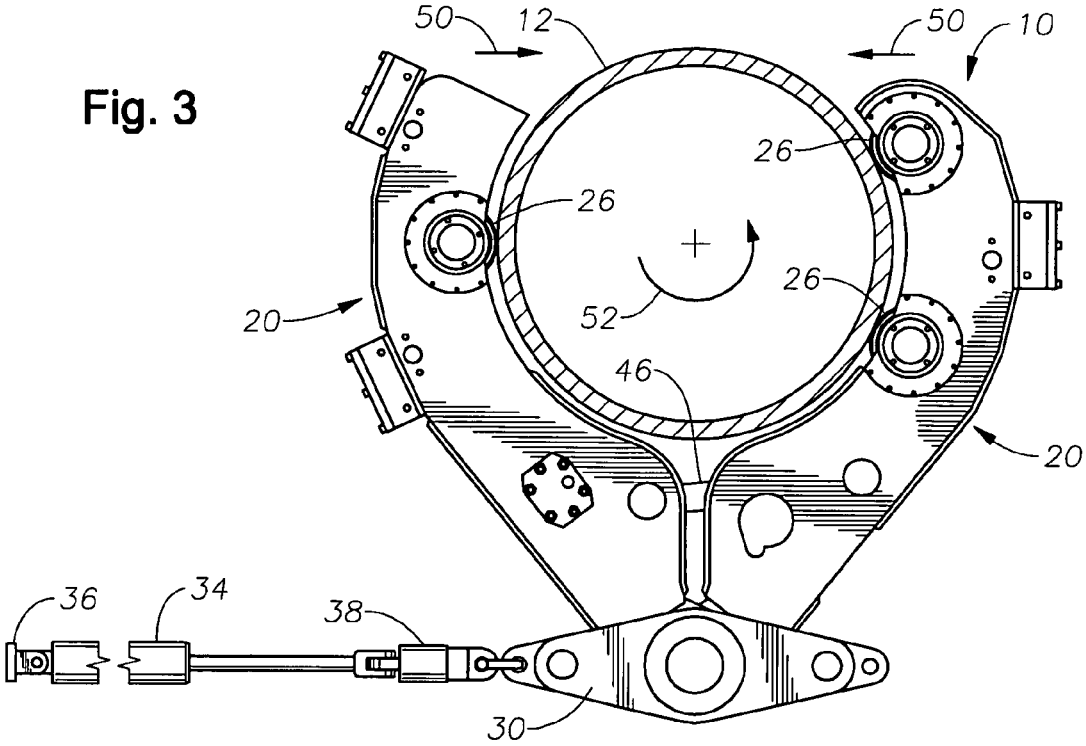
FIG. 3 is a top view of the spinner-wrench with arms in a closed condition with rollers engaging the tubular.

FIG. 3 is a top view of the spinner-wrench 10 with arms 20 in a closed condition with the rollers 26 engaging the tubular 12. Closing the arms 20 around the tubular in the direction of the arrows 50 is accomplished by contracting the displacer 46. As shown, the three rollers 26 engage the outer surface of the tubular 12 over an arc 52 that measures about 210 degrees. The displacer 46 maintains a closing force that biases the rollers 26 firmly against the tubular. The collar 30 is coupled to the fixed structure 36 by the displacer 34 and load cell 38.

Figure 4:
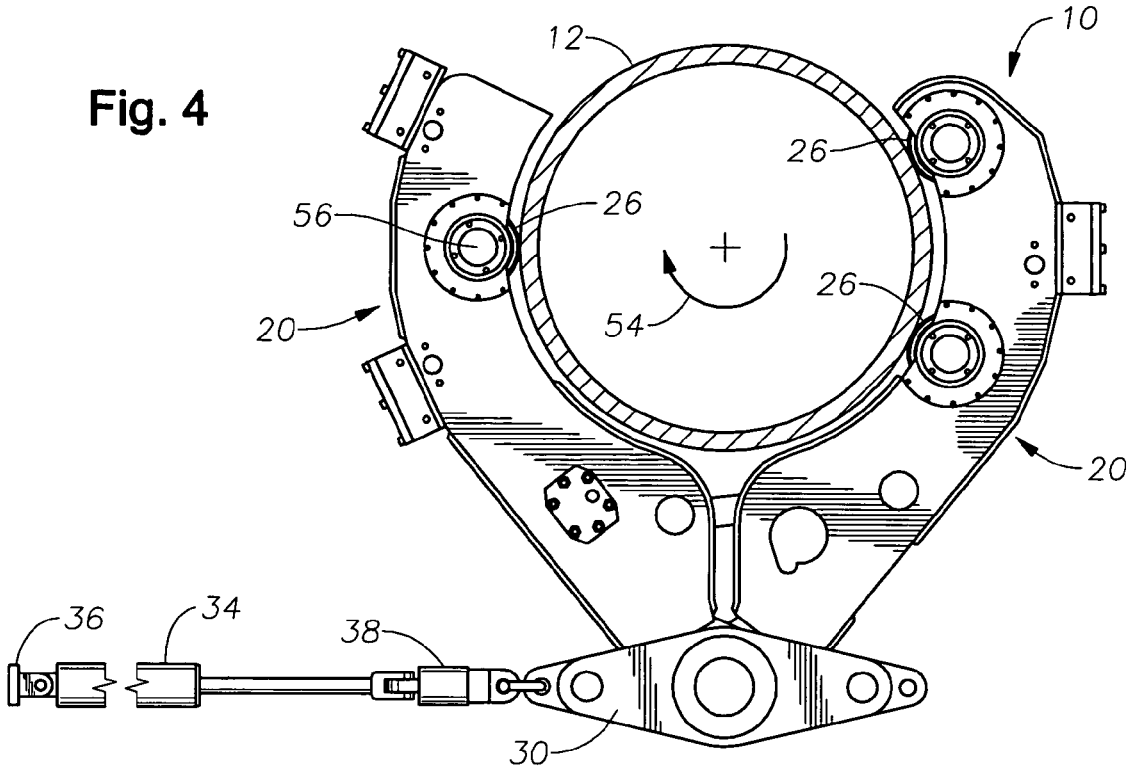
FIG. 4 is a top view of the spinner-wrench illustrating the spinning of the tubular.

FIG. 4 is a top view of the spinner-wrench 10 illustrating the clockwise spinning of the tubular 12 in the direction of the arrow 54 to makeup the threaded connection, which is accomplished by rotating one or more of the engaged rollers 26 in a counter-clockwise direction. At least one of the engaged rollers 26 must be mechanically coupled to a drive motor 56. Various drive motor positions and mechanical couplings are known in the art, but a drive motor 56 is shown positioned in axial alignment above a roller 26. Optionally, each roller 26 may have a drive motor 56. The drive motor is preferably a hydraulic or pneumatic motor to utilize existing pressurized fluid systems common on rigs, but may also be electrically powered. Each roller 26 is preferably generally cylindrical along its contact surface with an axis positioned generally vertically between two bearings or bushings secured to an arm 20. Each roller 26 preferably has a surface that extends radially inwardly from the arm 20 only a short distance, because this distance determines the minimal distance that the jaws (used in applying a final torque) must extend to engage and grip the tubular.

When the rollers spin the tubular, the threaded pin of the tubular 12 will screw into the threaded box of the tubular string 16 to makeup the connection. Under the force of the drive roller, the friction and other resistances to threading will bias the spinner-wrench 10 in the opposite direction (counter-clockwise). However, the displacer 34 and load cell 38 coupling the spinner-wrench 10 to fixed structure 36 prevent such counter-clockwise rotation. Accordingly, the load cell 38 is able to measure a force that is proportional to the torque applied to the threaded connection.

The embodiments of the present invention may be controlled or operated manually, automatically or some combination thereof. However, it is preferred to control the drive motor(s) 56 with a spinner control system. A spinner control system or circuit may monitor the forces measured by the load cell and/or other parameters, such as the spin rate of the tubular or the rollers, in order to identify shouldering or some other point at which it is desired to stop spinning. Upon detecting the appropriate predetermined parameter(s), the spinner control system will shut off the drive motor. Preferably, the spinner control system will also send a signal to a gripping control system or circuit that is responsible for actuating the jaws into gripping contact with the tubular. While the spinning and gripping functions may be manually controlled, the present apparatus is adaptable for automation.

Figure 5:
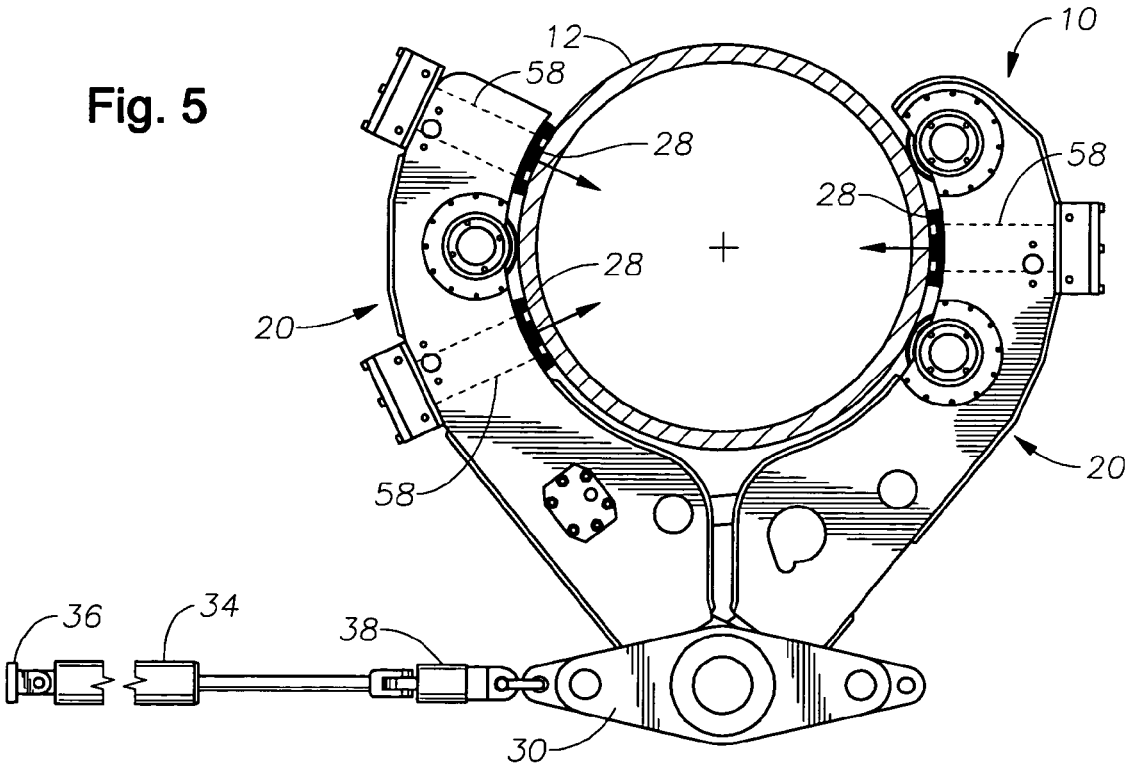
FIG. 5 is a top view of the spinner-wrench with the jaws extended to securely grip the tubular.

FIG. 5 is a top view of the spinner-wrench 10 with the arms 20 closed and the jaws 28 extended to securely grip the tubular 12. The jaws 28 are secured to jaw displacers 58 that are secured to the arms 20. The jaw displacers 58 may be pneumatically, hydraulically or electrically powered to and from their engaged positions against the tubular, but are preferably hydraulic cylinders in order to achieve the desired contact force of the jaws 28 against the tubular 12. While the jaws have separate cylinders, the cylinders may be in fluid communication with a common source of hydraulic fluid and may be activated simultaneously, such as with a single valve. So long as the jaws 28 engage and grip the tubular, it is not required that the rollers 26 disengage out of contact with the tubular. In accordance with one embodiment, the gripping control system may automatically actuate the jaws into gripping contact with the tubular immediately after the spinning is complete.

Figure 6:
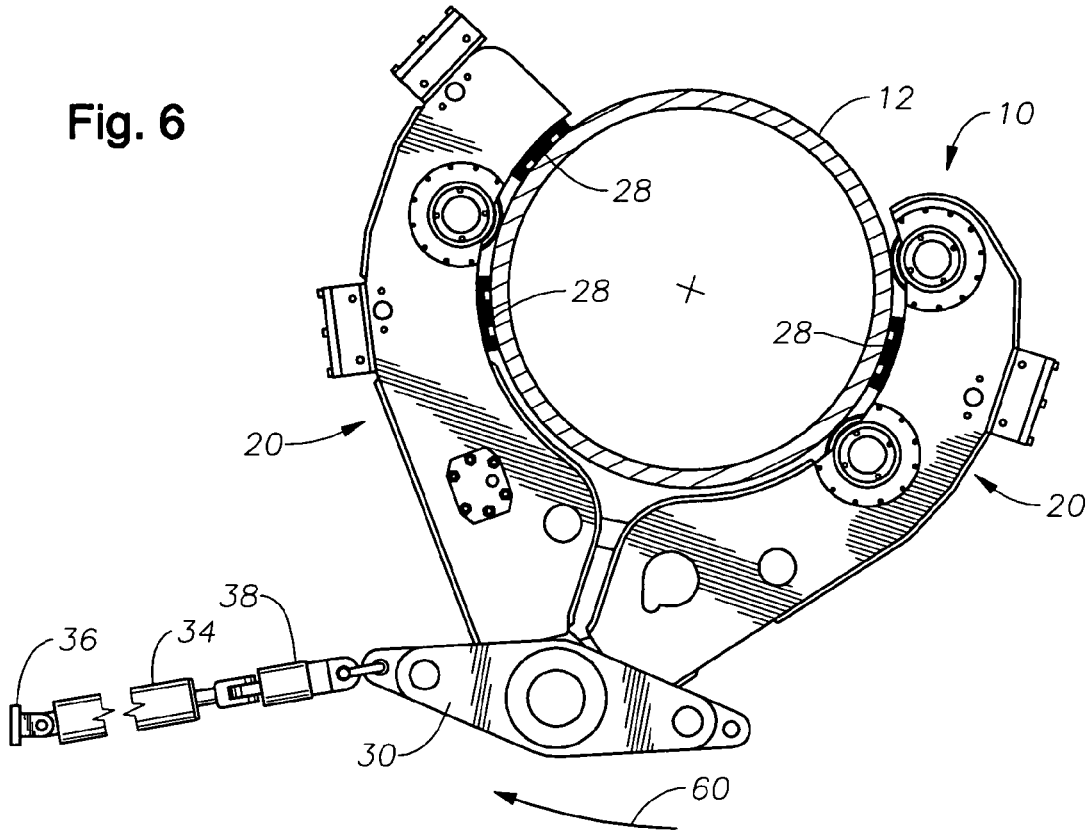
FIG. 6 is a top view of the spinner-wrench with a displacer applying a final torque value to the tubular.

FIG. 6 is a top view of the spinner-wrench 10 with the displacer 34 retracting to apply a final torque value to the tubular 12. The displacer 34 contracts to apply a force that is measured by the load cell 38 and applied against the collar 30 of the spinner-wrench 10. The displacer 34 preferably continues to apply this force and rotate the tubular 12 and the spinner-wrench 10 in the clockwise direction, as shown by the arrow 60, until the load cell 38 indicates that the actual torque achieves a predetermined final torque value. The displacer 34 may be controlled by a final torque control system or circuit that monitors the load cell measurements. For example, the final torque control system may retract or actuate the displacer 34 upon detecting that the rollers have stopped and the jaws have been deployed. The torque control system may relax the displacer 34 upon determining that the predetermined final torque value has been reached or, perhaps, that the displacement has exceeded a predetermined distance of travel.

While it is not the purpose of this disclosure to describe all manner of detecting the foregoing conditions, a few preferred detection means are described here. For example, determining that one or more of the rollers have stopped may be performed, with varying levels of certainty, by detecting a pressure condition in the hydraulic input line to a hydraulic drive motor 56, or by directly detecting rotation of either the roller or the tubular, or both. Determination that the jaws 28 have been deployed to engage and grip the tubular may be achieved by detecting a high pressure condition in the hydraulic input line to the jaw displacers 58 or by an appropriately positioned limit switch. The load cell measurements are intended to be the primary means of determining that the final torque value has been reached. Determining that the displacement of the displacer 34 has exceeded a predetermined distance may also be accomplished with a limit switch. If the displacer 34 exceeds the predetermined displacement, then it is likely that the spinner was terminated before shouldering of the threaded connection. Therefore, it may be necessary to retract the jaws and extend the displacer 34 to return to the condition of FIG. 4, then re-deploy the jaws as in FIG. 5 and actuate the displacer 34 as shown in FIG. 6. Visual observations by rig personnel will be valuable in determining the exact course of action.

Releasing the tubular 12 from the spinner-wrench 10 requires extending the displacer 46 between the two arms 20, as shown in FIG. 2. It is preferable to also retract the jaws 28 in order to be prepared for making up another connection. In fact, it is most preferably to retract the jaws 28 prior to extending the displacer 46 between the arms 20 in order to avoid unnecessary scoring of the tubular 12.

Figure 7:
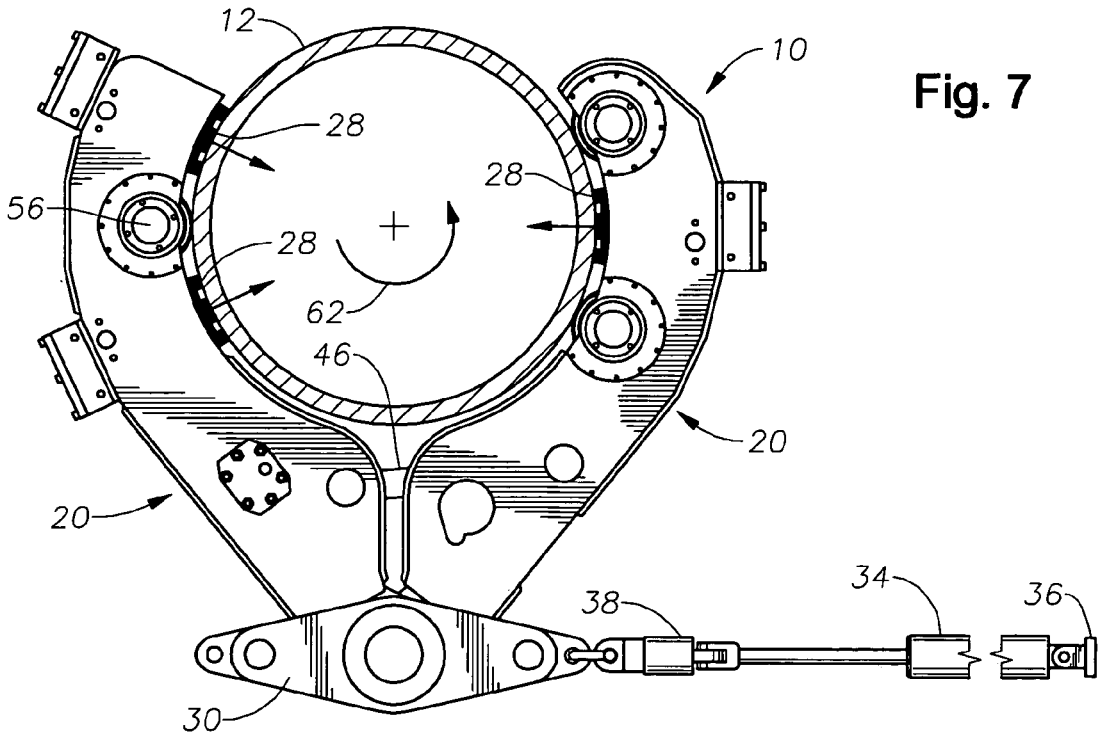
FIG. 7 is a top view of the spinner-wrench configured to break out threaded tubular connections.

FIG. 7 is a top view of the apparatus 10 configured to break out threaded tubular connections, such as during removal of a tubular string from the wellbore. To accomplish this, the apparatus 10 is used in essentially the opposite order of steps. In addition, the displacer 34 and load cell 38 are coupled between the same or different fixed structure 36 and the opposing side connector of the collar 30 in order to apply force in a counter-clockwise, break out direction (the opposite of arrow 60). In conjunction with this new arrangement of the apparatus 10, the manual backup tong will typically need to be reversed, depending upon its design, so that it can oppose counter-clockwise rotation of the tubular string 16.

Briefly, a threaded connection is broken and disconnected by contracting the displacer 46 to close the arms around the tubular, extending the jaws 28 to grip the tubular, contracting the displacer 34 to break or unseal the threaded connection, retracting the jaws 28, activating the drive motor 56 in a clockwise direction to rotate the tubular in a counter-clockwise direction as shown by arrow 62 (opposite of FIG. 4) until the threaded pin and box are disconnected, and extending the displacer 46 to open the arms 20. The disconnected tubular will typically be lifted out of the way by a joint elevator. A lift elevator may then grip the tubular string and, after disengaging the spider, lift the tubular string so that the next threaded connection is positioned above the spider, then reset the spider. The disconnection procedure is then repeated.

The terms "comprising," "including," and "having," as used in the claims and specification herein, shall indicate an open group that may include other elements not specified. The term "consisting essentially of," as used in the claims and specification herein, shall indicate a partially open group that may include other elements not specified, so long as those other elements do not materially alter the basic and novel characteristics of the claimed invention. The terms "a," "an," and the singular forms of words shall be taken to include the plural form of the same words, such that the terms mean that one or more of something is provided. For example, the phrase "an apparatus having a drive motor" should be read to describe an apparatus having one or more drive motors. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used in the specification to indicate that an item, condition or step being referred to is an optional (not required) feature of the invention.

While a preferred form of the present invention has been described herein, various modifications of the apparatus and method of the invention may be made without departing from the spirit and scope of the invention, which is more fully defined in the following claims.

What is claimed is:

1. An apparatus for connecting or disconnecting threaded tubulars, comprising:

a pair of arms pivotably coupled at a distal end;

a first displacer secured to the pair of arms for selectively moving a proximal region of the pair of arms into an open position for receiving or withdrawing a tubular and into a closed position for engaging and rotating a tubular;

three or more rollers rotationally secured to the proximal region of the pair of arms with at least one roller secured to each arm, the rollers collectively adapted for spanning at least 180 degrees of the circumference of a tubular received and engaged between the arms in the closed position, wherein at least one of the rollers is a drive roller for spinning a tubular;

two or more jaws secured to the proximal region of the pair of arms with at least one jaw secured to each arm, the jaws collectively spanning at least 180 degrees of the tubular circumference for selectively gripping a tubular with the arms in the closed position; and a second displacer secured between the distal end of the pair of arms and a fixed structure, wherein the fixed structure is positioned so that actuating the second displacer applies a generally tangential force for applying a final torque value to a tubular gripped by the jaws.

2. The apparatus of claim 1 wherein the first and second displacers are independently selected from a hydraulic cylinder, a pneumatic cylinder, a jack, and a winch.

3. The apparatus of claim 1 wherein the three or more rollers extend a fixed distance radially inward from the arms for engaging the tubular.

4. The apparatus of claim 1, wherein the two or more jaws are each secured to the pair of arms by separate displacers for selectively moving the two or more jaws between a disengaged position radially outward of the three or more rollers and an engaged position radially inward of the three or more rollers.

5. The apparatus of claim 1 wherein the torque applied by the second displacer is rotationally directed to makeup the tubular.

6. The apparatus of claim 1 wherein the torque applied by the second displacer is rotationally directed to break out the tubular.

7. The apparatus of claim 1, further comprising:

a load cell disposed to measure the force applied to the tubular.

8. The apparatus of claim 7, wherein the load cell measures torque while spinning the tubular and while applying a generally tangential force.

9. The apparatus of claim 1, further comprising:

a manual backup tong for rotationally gripping a tubular string adapted for threaded connection with the tubular.

10. The apparatus of claim 9, further comprising:

a backup snubline secured between the manual backup tong and a fixed structure to oppose the generally tangential force.

11. The apparatus of claim 10, wherein the backup snubline and the second displacer have one end secured to the same fixed structure.

12. The apparatus of claim 9, wherein the pair of arms is positioned axially adjacent a threaded pin of the tubular and the manual backup tong is positioned axially adjacent a threaded box of the tubular string.

13. The apparatus of claim 1, wherein a backup tong is secured to the apparatus.

14. The apparatus of claim 1, further comprising: a spider for rotationally gripping a tubular string adapted for threaded connection with the tubular.

15. A method of making a threaded connection between tubulars, comprising:

axially aligning a tubular for threadably connecting with a tubular string;

positioning a proximal region of a pair of moveable arms around the tubular;

closing the pair of moveable arms around the tubular to create a contact force between three or more rollers, including at least one drive roller, and the tubular, wherein the three or more rollers are collectively adapted for maintaining axial alignment of the tubular;

securing the tubular string to oppose rotation;

spinning the tubular in a makeup direction to threadably connect the tubular;

extending two or more jaws from the pair of moveable arms to a position radially inward of the rollers to securely grip the tubular;

directing a generally tangential force against a distal end of the pair of moveable arms in the makeup direction to apply a final torque value to the threaded connection; and opening the pair of moveable arms to disengage the tubular.

16. The method of claim 15, wherein the step of directing a generally tangential force against a distal end of the pair of moveable arms includes actuating a displacer coupled between the distal end and a fixed structure.

17. The method of claim 16, wherein the step of securing the tubular string to oppose rotation includes attaching a manual backup tong.

18. The method of claim 17, wherein the displacer and the manual backup tong are secured to the same fixed structure.

19. The method of claim 15, further comprising:

spinning the tubular in the makeup direction until achieving a threaded connection that is less than one-quarter turn of the tubular from arriving at a target final torque value.

20. The method of claim 19, wherein the spinning is controlled by a drive motor driving the at least one drive roller.

21. The method of claim 20, further comprising:

automatically stopping the drive motor and extending the jaws upon detecting a predetermined toque value that is less than the target final torque value.

22. The method of claim 20 wherein the drive motor is one or more of pneumatic, hydraulic or electric.

23. An apparatus for connecting or disconnecting threaded tubulars, comprising:

a first pair of arms pivotably coupled at a distal end for gripping a tubular segment;

a first displacer secured to the first pair of arms for selectively moving a proximal region of the first pair of arms into an open position for receiving or withdrawing a tubular and into a closed position for engaging and rotating a tubular;

three or more rollers rotationally secured to the proximal region of the first pair of arms with at least one roller secured to each arm, the rollers collectively adapted for spanning at least 180 degrees of the circumference of a tubular segment received and engaged between the arms in the closed position, wherein at least one of the rollers is a drive roller for spinning a tubular segment;

two or more jaws secured to the proximal region of the first pair of arms with at least one jaw secured to each arm, the jaws positionable for collectively spanning at least 180 degrees of a tubular segment circumference for selectively gripping a tubular segment with the arms in the closed position; and a second displacer disposed between the distal end of the first pair of arms and a backup tong comprising a second pair of arms that is rotatably coupled with the first pair of arms, wherein the backup tong is adapted for engaging and holding the proximal end of a tubular string at a location below a joint to be threadably made up, and wherein actuation of the second displacer applies a final torque to the threaded joint between the tubular string gripped by the second pair of arms and the tubular segment gripped by the first pair of arms.

* * * * *